US011600259B2

(12) United States Patent
Yang

(10) Patent No.: US 11,600,259 B2
(45) Date of Patent: Mar. 7, 2023

(54) VOICE SYNTHESIS METHOD, APPARATUS, DEVICE AND STORAGE MEDIUM

(71) Applicant: BAIDU ONLINE NETWORK TECHNOLOGY (BEIJING) CO., LTD., Beijing (CN)

(72) Inventor: Jie Yang, Beijing (CN)

(73) Assignee: BAIDU ONLINE NETWORK TECHNOLOGY (BEIJING ) CO., LTD.

( * ) Notice: Subject to any disclaimer, the term of this patent is extended or adjusted under 35 U.S.C. 154(b) by 47 days.

(21) Appl. No.: 16/565,784

(22) Filed: Sep. 10, 2019

(65) Prior Publication Data

US 2020/0005761 A1 Jan. 2, 2020

(30) Foreign Application Priority Data

Dec. 20, 2018 (CN) ..... 201811567415.1

(51) Int. Cl.
*G10L 13/027* (2013.01)
*G10L 13/033* (2013.01)
*G10L 13/08* (2013.01)

(52) U.S. Cl.
CPC ..... *G10L 13/027* (2013.01); *G10L 13/033* (2013.01); *G10L 13/08* (2013.01)

(58) Field of Classification Search
None
See application file for complete search history.

(56) References Cited

U.S. PATENT DOCUMENTS 9,418,654 B1 8/2016 Killalea et al.
2013/0262119 A1* 10/2013 Latorre-Martinez ... G10L 13/08 704/260

FOREIGN PATENT DOCUMENTS

CN 105096932 A 11/2015
CN 108091321 A * 5/2018 ..... G10L 13/02
CN 108091321 A 5/2018
CN 108962217 A * 12/2018 ..... G10L 13/02
(Continued)

OTHER PUBLICATIONS

Nur Syafikah Binti Samsudin; Kazunori Mano; Comparison of Native and Nonnative Speakers' Perspective In Animated Text Visualization Tool; Nov. 2015; URL: https://ieeexplore.ieee.org/document/7372934?source=IQplus (Year: 2015).*
(Continued)

*Primary Examiner* — Richa Mishra
(74) *Attorney, Agent, or Firm* — Dilworth IP, LLC

(57) ABSTRACT

Provided are a voice synthesis method, an apparatus, a device, and a storage medium, involving obtaining text information and determining characters in the text information and a text content of each of the characters; performing a character recognition on the text content of each of the characters, to determine character attribute information of each of the characters; obtaining speakers in one-to-one correspondence with the characters according to the character attribute information of each of the characters, where the speakers are pre-stored pronunciation object having the character attribute information; and generating multi-character synthesized voices according to the text information and the speakers corresponding to the characters of the text information. These improve pronunciation diversities of different characters in the synthesized voices, improve an audience's discrimination between different characters in the synthesized voices, and thereby improve experience of a user.

9 Claims, 3 Drawing Sheets

(56) References Cited

FOREIGN PATENT DOCUMENTS

| | | | |
|---|---|---|---|
| CN | 108962217 | A | 12/2018 |
| CN | 109523988 | A | 3/2019 |

OTHER PUBLICATIONS

First Office Action Issued in Chinese Patent Application No. 201811567415, dated Jul. 1, 2020, 7 pages.
Second Office Action in CN Patent Application No. 201811567415.1 dated Jan. 15, 2021.

* cited by examiner

VOICE SYNTHESIS METHOD, APPARATUS, DEVICE AND STORAGE MEDIUM

CROSS-REFERENCE TO RELATED APPLICATIONS

This application claims priority to Chinese Patent Application No. 201811567415.1, filed on Dec. 20, 2018, which is incorporated herein by reference in its entirety.

TECHNICAL FIELD

Embodiments of the present disclosure relate to the technical field of unmanned vehicle and, in particular, to a voice synthesis method, an apparatus, a device, and a storage medium.

BACKGROUND

With the development of the voice technology, the voice technology has begun to be applied to all aspects of people's lives and works. For example, in a scene such as audio reading, human-machine dialogue, smart speaker, smart customer service, etc., a device may send out a synthesized voice to serve a user.

In the prior art, a text to be processed may be obtained, and then the text is processed by using a voice synthesis technology to obtain a voice.

However, in the prior art, only a single speaker may be obtained through the voice synthesis technology, but for a multi-character scene, a multi-character synthesized voice cannot be obtained. For example, when performing audio reading, it is necessary to obtain dialogue voices of a plurality of characters, but can only obtain a voice of a single speaker by performing voice synthesis on a text in the prior art.

SUMMARY

Embodiments of the present disclosure provide a voice synthesis method, an apparatus, a device and a storage medium, realizing the matching of suitable voices for text contents of different characters, distinction between different characters by voice characteristics, thereby improving performance of a text being converted into a voice, and improving the user experience.

A first aspect of the present disclosure provides a voice synthesis method, including:

obtaining text information and determining characters in the text information and a text content of each of the characters;

performing a character recognition on the text content of each of the characters, to determine character attribute information of each of the characters;

obtaining speakers in one-to-one correspondence with the characters according to the character attribute information of each of the characters, wherein the speakers are pre-stored speakers having the character attribute information; and generating multi-character synthesized voices according to the text information and the speakers corresponding to the characters of the text information.

Optionally, the character attribute information includes a basic attribute, and the basic attribute includes a gender attribute and/or an age attribute;

before the obtaining speakers in one-to-one correspondence with the characters according to the character attribute information of each of the characters, the method further includes:

determining the basic attribute corresponding to each of the pre-stored speakers according to voice parameter information of the pre-stored speakers; and correspondingly the obtaining speakers in one-to-one correspondence with the characters according to the character attribute information of each of the characters includes:

for each of the characters, obtaining a speaker having the basic attribute corresponding to the each of the characters.

Optionally, the character attribute information further includes an additional attribute, and the additional attribute includes at least one of the following:

regional information, timbre information, and pronunciation style information;

before the obtaining speakers in one-to-one correspondence with the characters according to the character attribute information of each of the characters, the method further includes:

determining the additional attribute and additional attribute priority corresponding to each of the pre-stored speakers according to the voice parameter information of the pre-stored speakers; and correspondingly the obtaining speakers in one-to-one correspondence with the characters according to the character attribute information of each of the characters further includes:

from speakers having the basic attribute corresponding to the characters, determining the speakers in one-to-one correspondence with the characters according to the additional attribute.

Optionally, the from speakers having the basic attribute corresponding to the characters, determining the speakers in one-to-one correspondence with the characters according to the additional attribute includes:

obtaining a character voice description class keyword in text contents of the characters;

determining the additional attribute corresponding to the characters according to the character voice description class keyword;

in the speakers having the basic attribute corresponding to the characters, determining the speakers in one-to-one correspondence with the characters having the additional attribute corresponds to the characters.

Optionally, the from speakers having the basic attribute corresponding to the characters, determining the speakers in one-to-one correspondence with the characters according to the additional attribute includes:

in the speakers having the basic attribute corresponding to the characters, using speakers with the highest additional attribute priorities as the speakers in one-to-one correspondence with the characters.

Optionally, the obtaining speakers in one-to-one correspondence with the characters according to the character attribute information of each of the characters includes:

obtaining a candidate speaker for each of the characters according to the character attribute information of the each of the characters;

displaying description information of the candidate speaker to a user and receiving an indication of the user; and obtaining the speakers in one-to-one correspondence with the characters in the candidate speaker of each of the characters according to the instruction of the user.

Optionally, the generating multi-character synthesized voices according to the text information and the speakers corresponding to the characters of the text information includes:

processing a corresponding text content in the text information according to the speakers corresponding to the characters, to generate the multi-character synthesized voices.

Optionally, after the processing a corresponding text content in the text information according to the speakers corresponding to the characters, to generate the multi-character synthesized voices, the method further includes:

obtaining a background audio that are matched with a plurality of consecutive text contents in the text information; and adding the background audio to voices corresponding to the plurality of text contents in the multi-character synthesized voices.

According to a second aspect of the present disclosure, a voice synthesis apparatus is provided, including:

an extraction module, configured to obtain text information, and determine characters in the text information and a text content of each of the characters;

a recognition module, configured to perform a character recognition on the text content of each of the characters, to determine character attribute information of each of the characters;

a selection module, configured to obtain speakers in one-to-one correspondence with the characters according to the character attribute information of each of the characters, where the speakers are pre-stored speakers having the character attribute information; and a synthesis module, configured to generate multi-character synthesized voices according to the text information and the speakers corresponding to the characters of the text information.

According to a third aspect of the present disclosure, a device is provided, including: a memory, a processor, and a computer program, where the computer program is stored in the memory, the processor runs the computer program to perform the voice synthesis methods in the first aspect and various possible designs of the first aspect of the present disclosure.

According to a fourth aspect of the present disclosure, a readable storage medium is provided, the readable storage medium stores a computer program that, when being executed by a processor, implements the voice synthesis methods in the first aspect or various possible designs of the first aspect of the present disclosure.

The embodiments of the present disclosure provide a voice synthesis method, an apparatus, a device, and a storage medium, involving obtaining text information and determining characters in the text information and a text content of each of the characters; performing a character recognition on the text content of each of the characters, to determine character attribute information of each of the characters; obtaining speakers in one-to-one correspondence with the characters according to the character attribute information of each of the characters, where the speakers are pre-stored speakers having the character attribute information; and generating multi-character synthesized voices according to the text information and the speakers corresponding to the characters of the text information. These improve pronunciation diversities of different characters in the synthesized voices, improve an audience's discrimination between different characters in the synthesized voices, and thereby improve experience of a user.

BRIEF DESCRIPTION OF DRAWINGS

To describe the technical solutions in embodiments of the present disclosure or in the prior art more clearly, the following briefly introduces the accompanying drawings needed for describing the embodiments or the prior art. Apparently, the accompanying drawings in the following descriptions are some embodiments of the present disclosure, and for persons of ordinary skill in the art, other drawings can be obtained according to these accompanying drawings without creative effort.

DESCRIPTION OF EMBODIMENTS

To make the objectives, technical solutions, and advantages of embodiments of the present disclosure clearer, the following clearly and comprehensively describes the technical solutions in embodiments of the present disclosure with reference to the accompanying drawings of the embodiments of the present disclosure. Apparently, the described embodiments are merely part of embodiments of the present disclosure rather than all embodiments. All other embodiments obtained by persons of ordinary skill in the art based on the embodiments of the present disclosure without creative effort shall fall within the protection scope of the present disclosure.

It should be understood that in various embodiments of the present disclosure, big or small of sequence numbers in processes does not mean an order of execution, and the order of execution of the processes should be determined by function and internal logic thereof, and should not constitute any limitation to implementation processes of the embodiments of the present disclosure.

It should be understood that in the embodiments of the present disclosure, "include" and "have" and any variants thereof are intended to cover a non-exclusive inclusion, for example, a process, a method, a system, a product or a device including a series of steps or units is not necessary to be limited to those steps or units that are clearly listed, but may include other steps or units that are not explicitly listed or are inherent in these process, method, product, or device.

It should be understood that in the embodiments of the present disclosure, "a plurality of" means two or more than two. "including A, B, and C" and "including A, B, C" means that A, B, and C are all included, and "including A, B, or C" means including one of A, B, and C. "including A, B, and/or C" means including any one or two or three of A, B, and C.

With respect to the problem of voice synthesis sound being single in the prior art, the present disclosure provides a voice synthesis method, an apparatus, a device, and a storage medium, which may analyze text information, distinguish characters in text contents, and then configure appropriate speakers for the text contents of different characters, so as to perform processing on the text contents of the characters according to the speakers, to obtain multi-character synthesized voices that may distinguish sounds of the characters, where the speakers selected for the characters are determined according to the text content of the characters, conforms to language characteristics of the characters and may have a high degree of matching with the characters, thereby improving the user experience. This solution will be described in detail below through several specific embodiments.

Figure 1:
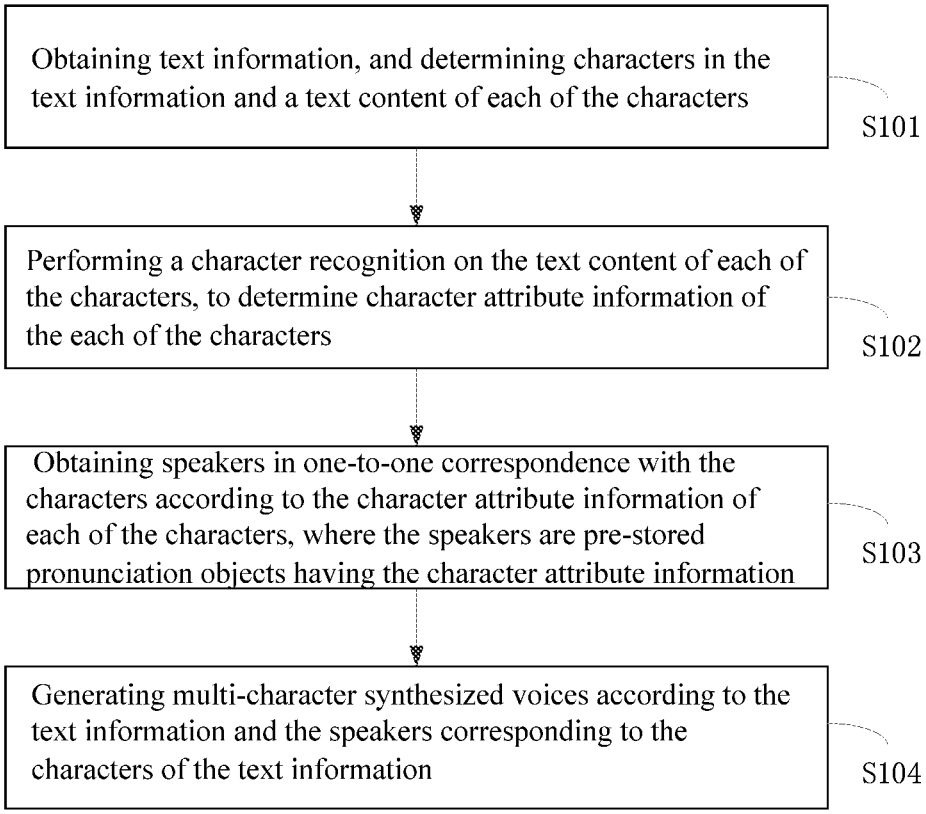
FIG. 1 is a schematic flowchart of a voice synthesis method according to an embodiment of the present disclosure.

FIG. 1 is a schematic flowchart of a voice synthesis method according to an embodiment of the present disclosure. As shown in FIG. 1, an executive entity of the solution may be a device with a data processing function, such as a server or a terminal, the method as shown in FIG. 1 refers to the following steps S101 to S104.

S101, obtaining text information, and determining characters in the text information and a text content of each of the characters.

Specifically, the text information may be information having a specific format or information containing a dialog content. In an embodiment of the information having a specific format, for example, the text information includes a character identifier, a separator, and text contents of the characters. The following is an example of the text information:

A: Dad, how is the weather today, is it cold?

B: It's a sunny day! not cold.

A: Wow! can we fly a kite? Mom . . . .

C: Yes, we will go after breakfast.

In the above example, A, B, and C are character identifiers, and the separator is ":". The text content of the character A is "Dad, how is the weather today, is it cold?" and "Wow! Can we fly a kite? Mom "; the text content of the character B is" It's a sunny day! not cold." The text content of the character C is "Yes, we will go after breakfast." The character identifier may be a letter as in the above example, or may be a specific name, such as "father", "mother" or "Zhang San" and other identifying information.

S102, performing a character recognition on the text content of each of the characters, to determine character attribute information of each of the characters.

In some embodiments, the character attribute information of each of the characters may be a recognition result obtained by analyzing a text content through a preset natural language processing (NLP) model. The NLP model is a classification model, which may analyze inputted text content and assign a corresponding label or category according to processing methods such as splitting and classified processing of language and text. For example, classifying the gender and age attributes of each character. For example, gender attribute of a character is male, female, or vague, and the age attribute is old, middle-aged, youth, teenager, child, or vague. For example, after obtaining a text content of each character, the text content corresponding to a character identifier of each character (for example, the text content of the character A is "Dad, what is the weather today, cold?" and "Wow! Can we fly a kite? Mom . . . ") may be used as a model input, and is inputted into a preset NLP model, and is processed to obtain the character attribute information corresponding to the character identifier (for example, the age attribute corresponding to the character A is child, the gender attribute is vague). If the age and gender are all vague, it may be a text content corresponding to narration.

S103, obtaining speakers in one-to-one correspondence with the characters according to the character attribute information of each of the characters, where the speakers are pre-stored speakers having the character attribute information.

The speaker can be understood as a model having a voice synthesis function, and each speaker is configured with unique character attribute information for making the outputted voice has character's uniqueness by setting voice parameters when synthesizing the voice. For example, a speaker having a character attribute of an old man or a male adopts a low frequency when synthesizing a voice, so that the outputted voice has a low and deep voice characteristic. For example, a speaker having a character attribute of a youth or a female adopts a high frequency when synthesizing a voice, so that the outputted voice has a sharp voice characteristic. In addition, other voice parameters may be set such that each speaker has a different voice characteristic.

In some embodiments, the character attribute information includes a basic attribute, the basic attribute includes a gender attribute and/or an age attribute. Before the step S103 (obtaining speakers in one-to-one correspondence with the characters according to the character attribute information of each of the characters), the method may further include:

determining the basic attribute corresponding to each of the pre-stored speakers according to voice parameter information of the pre-stored speakers. It can be understood that the basic attribute of each speaker is predetermined and roughly classified. Correspondingly, the implementation of step S103 may be: for each of the characters, obtaining a speaker having the basic attribute corresponding to the each of the character. Specifically, a speaker may be obtained for each character according to the gender attribute and/or the age attribute corresponding to the character, where the speaker corresponding to the character has the gender attribute and/or the age attribute corresponding to the character. For example, for the character A, the basic attribute obtained is "age: child; gender: vague gender", thereby a speaker corresponding to the child may be obtained. However, the same technical attribute may correspond to a plurality of speakers, for example, there are 30 speakers corresponding to the child, so it is necessary to further select one that is best matched with the character from the 30 speakers.

In some embodiments, the character attribute information further includes an additional attribute. The speakers is further screened by an introduction of the additional attribute.

Before the step S103 (obtaining speakers in one-to-one correspondence with the characters according to the character attribute information of each of the characters), the method may further include: determining the additional attribute and additional attribute priority corresponding to each of the pre-stored speakers according to the voice parameter information of the pre-stored speakers. The additional attribute includes at least one of the following:

regional information, timbre information, and pronunciation style information.

Where, the regional information is for example directed to voices with different regional pronunciation characteristics, for example, regarding the same word "pie", it is pronounced as "pie" in south China, and "pasty" in north China, thereby the regional information may be introduced as an optional additional attribute to rich materials of the synthesized voice.

The pronunciation style information is for example directed to voice characteristics such as an accent's position and voice speed. The distinction degree between different characters may be improved by different pronunciation styles. For example, for a same text content of young women, one uses a speaker with front accent and slow voice speed to perform a voice synthesis, and the other uses a speaker with back accent and fast voice speed to perform a voice synthesis, the voices of both may have a larger difference, improving discrimination of a listener to different characters.

Correspondingly, the step S103 (obtaining speakers in one-to-one correspondence with the characters according to the character attribute information of each of the characters) further includes: in the speakers having the basic attribute corresponding to the characters, determining the speaker in one-to-one correspondence with the character according to the additional attribute. Specifically, it may be first determined whether the speaker having the basic attribute corresponding to the character is unique, and if yes, the unique speaker is used as the speaker in one-to-one correspondence with the character; if no, in the speakers having the basic attribute corresponding to the characters, the speakers in one-to-one correspondence with the characters is determined according to the additional attribute.

In the above embodiment, an implementation of the from speakers having the basic attribute corresponding to the characters, determining the speakers in one-to-one correspondence with the characters according to the additional attribute may be:

obtaining a character voice description class keyword in the text content of the characters; determining the additional attribute corresponding to the characters according to the character voice description class keyword; and in the speakers having the basic attribute corresponding to the characters, determining the speakers in one-to-one correspondence with the characters having the additional attribute corresponds to the characters. Where, the character voice description class keyword is, for example, a description of a character voice in a text content, such as, if the text content corresponding to the narration contains "her cheerful voice makes people happy . . . ", then "cheerful" is extracted as the character voice description class keyword, thereby determining a corresponding additional attribute.

In the above embodiment, in another implementation of the from speakers having the basic attribute corresponding to the characters, determining the speakers in one-to-one correspondence with the characters according to the additional attribute may be:

in the speakers having the basic attribute corresponding to the characters, using speakers with highest additional attribute priorities as the speakers in one-to-one correspondence with the characters. For example, the additional attribute priority of standard Mandarin characteristics is set to an additional attribute that is higher than northern characteristics.

In some embodiments, a corresponding speaker may be selected for each character according to a user's indication, for example, a specific implementation of step S103 (obtaining speakers in one-to-one correspondence with the characters according to the character attribute information of each of the characters) may be: obtaining a candidate speaker for each of the characters according to the character attribute information of the each of the characters; displaying description information of the candidate speaker to a user and receiving an indication of the user; obtaining the speakers in one-to-one correspondence with the characters in the candidate speaker of each of the characters according to the instruction of the user. For example, for the character A, its gender is recognized as vague, so that the selection of candidate speaker can be done only according to the age as a child, and a plurality of candidate speakers may be obtained, and the user may select a candidate speaker with a gender of female and the pronunciation style being of a fast voice speed, as a speaker corresponding to the character A.

S104, generating multi-character synthesized voices according to the text information and speakers corresponding to the characters of the text information.

For example, it may be that the corresponding text content in the text information is processed according to the speakers corresponding to the characters to generate the multi-character synthesized voices. It can be understood that different speakers are selected for processing as the change of the processed text contents, thereby obtaining multi-character synthesized voices with different character pronunciation characteristics.

This embodiment provides a voice synthesis method, by obtaining text information and determining characters in the text information and a text content of each of the characters; performing a character recognition on the text content of each of the characters, to determine character attribute information of the each of the characters; obtaining speakers in one-to-one correspondence with the characters according to the character attribute information of each of the characters, wherein the speakers are pre-stored speakers having the character attribute information; and generating multi-character synthesized voices according to the text information and the speakers corresponding to the characters of the text information, pronunciation diversity of different characters in the synthesized voices is improved, an audience's discrimination for different characters in the synthesized voices is improved, and a user experience is improved.

Figure 2:
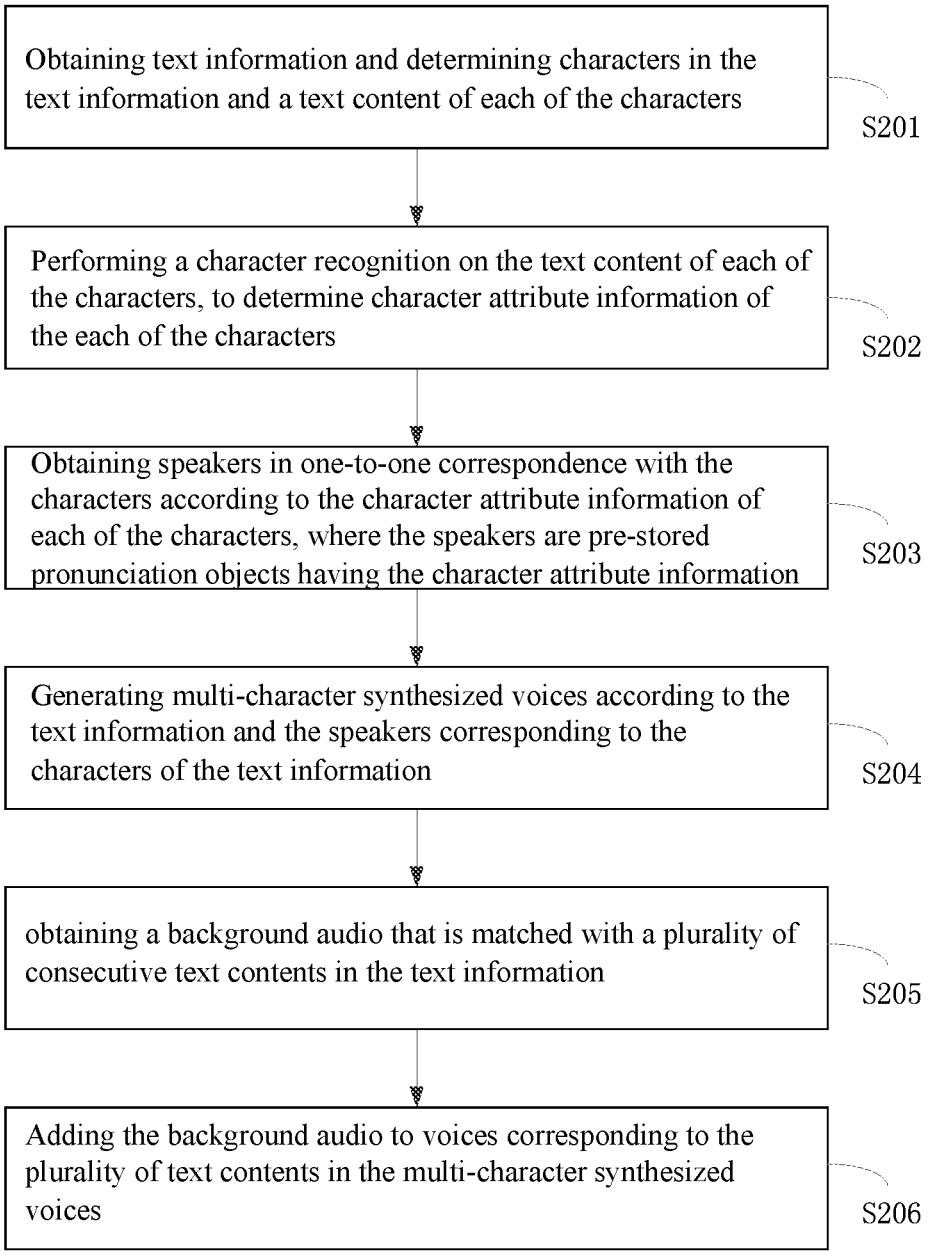
FIG. 2 is a schematic flowchart of another voice synthesis method according to an embodiment of the present disclosure.

After the speakers corresponding to the characters process a corresponding content in the text information to generate multi-character synthesized voices, a background audio may be added to a voice according to the text contents, thereby further improving richness and expressiveness of the synthesized voices, and improving the user experience. FIG. 2 is a schematic flowchart of another voice synthesizing method according to an embodiment of the present disclosure. The method shown in FIG. 2 refers to the following steps S201 to S206.

S201, obtaining text information and determining characters in the text information and a text content of each of the characters.

S202, performing a character recognition on the text content of each of the characters, to determine character attribute information of the each of the characters.

S203, obtaining speakers in one-to-one correspondence with the characters according to the character attribute information of each of the characters, where the speakers are pre-stored speakers having the character attribute information.

S204, generating multi-character synthesized voices according to the text information and the speakers corresponding to the characters of the text information.

For the specific implementation processes of the steps S201 to S204, they may refer to the steps S101 to S104 shown in FIG. 1, and have implementation principles and technical effects are similar thereto, and details are not described herein again.

S205, obtaining a background audio that is matched with a plurality of consecutive text contents in the text information.

For example, a dialogue emotion analysis is performed on a plurality of text contents in the text information, and when the emotion analysis result is an obvious emotion such as strong sadness, fear, happiness, etc., a background audio matching with the emotion is obtained from a preset audio library.

S206, adding the background audio to voices corresponding to the plurality of text contents in the multi-character synthesized voices.

In the multi-character synthesized voices, voice timestamps corresponding to the plurality of text contents may also be obtained as a positioning. Then background audios are added to the voices corresponding to the timestamps to enhance voice atmosphere and improve the user experience.

Figure 3:
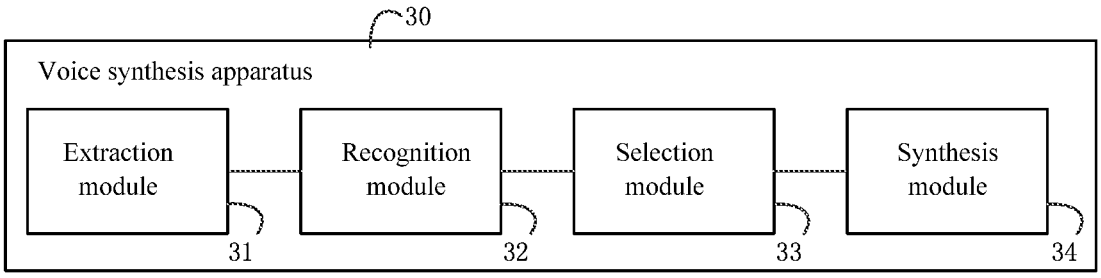
FIG. 3 is a schematic structural diagram of a voice synthesis apparatus according to an embodiment of the present disclosure.

FIG. 3 is a schematic structural diagram of a voice synthesis apparatus according to an embodiment of the present disclosure, and the voice synthesis apparatus 30 shown in FIG. 3 includes:

an extraction module 31, configured to obtain text information, and determine characters in the text information and a text content of each of the characters.

a recognition module 32, configured to perform a character recognition on the text content of each of the characters, to determine character attribute information of the each of the characters.

a selection module 33, configured to obtain speakers in one-to-one correspondence with the characters according to the character attribute information of each of the characters, where the speakers are pre-stored speakers having the character attribute information.

a synthesis module 34, configured to generate multi-character synthesized voices according to the text information and the speakers corresponding to the characters of the text information.

The apparatus in the embodiment shown in FIG. 3 can be used to perform the steps in the embodiments of the methods shown in FIG. 1 or FIG. 2, and has an implementation principle and technical effects similar thereto, and details are not described herein again.

Optionally, the character attribute information includes a basic attribute, the basic attribute includes a gender attribute and/or an age attribute.

The selection module 33 is further configured to determine the basic attribute corresponding to each of pre-stored speakers according to voice parameter information of the pre-stored speakers, before the obtaining the speakers in one-to-one correspondence with the characters according to the character attribute information of each of the characters.

Correspondingly, the selection module 33 is configured to obtain, for each of the characters, a speaker having the basic attribute corresponding to the each of the characters.

Optionally, the character attribute information further includes an additional attribute, the additional attribute includes at least one of the following:

regional information, timbre information, and pronunciation style information.

The selection module 33 is further configured to determine the additional attribute and additional attribute priority corresponding to each of the pre-stored speakers according to the voice parameter information of the pre-stored speakers, before the obtaining the speakers in one-to-one correspondence with the characters according to the character attribute information of each of the characters;

Correspondingly, the selection module 33 is further configured to determine, from speakers having the basic attribute corresponding to the characters, the speakers in one-to-one correspondence with the characters according to the additional attribute.

Optionally, the selection module 33 is configured to obtain a character voice description class keyword in the text content of the characters; determine the additional attribute corresponding to the characters according to the character voice description class keyword; and determine, in the speakers having the basic attribute corresponding to the characters, the speakers in one-to-one correspondence with the characters having the additional attribute corresponds to the characters.

Optionally, the selection module 33 is configured to use, in the speakers having the basic attribute corresponding to the characters, speakers with highest additional attribute priorities as the speakers in one-to-one correspondence with the characters.

Optionally, the selection module 33 is configured to obtain a candidate speaker for each of the characters according to the character attribute information of the each of the characters; display description information of the candidate speaker to a user and receiving an indication of the user; and obtain the speakers in one-to-one correspondence with the characters in the candidate speaker of each of the characters according to the instruction of the user.

Optionally, the synthesis module 34 is configured to process a corresponding text content in the text information according to a speaker corresponding to each of the characters, to generate the multi-character synthesized voices.

Optionally, the synthesis module 34 is further configured to, after processing the corresponding text content in the text information according to the speakers corresponding to the characters to generate the multi-character synthesized voices, obtain a background audio that is matched with a plurality of consecutive text contents in the text information; and add the background audio to voices corresponding to the plurality of text contents in the multi-character synthesized voices.

Figure 4:
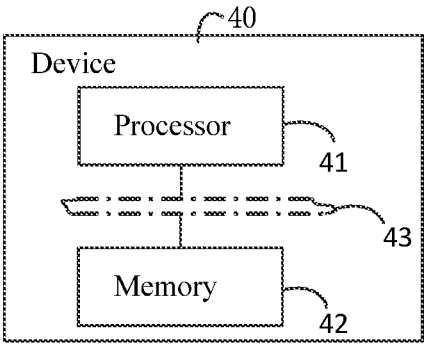
FIG. 4 is a schematic structural diagram of hardware of a device according to an embodiment of the present disclosure.

FIG. 4 is a schematic structural diagram of hardware of a device according to an embodiment of the present disclosure, and the device 40 includes a processor 41, a memory 42 and a computer program; where the memory 42 is configured to store the computer program, and the memory may also be a flash. The computer program is, for example, an application program, a function module, or the like that implements the above method.

The processor 41 is configured to execute the computer program stored in the memory to implement the steps in the voice synthesis method. The details can refer to the related description in the foregoing embodiments of the methods.

Optionally, the memory 42 may be either stand-alone or integrated with the processor 41.

When the memory 42 is an element independent of the processor 41, the device may further include:

a bus 43 configured to connect the memory 42 and the processor 41

The present disclosure also provides a readable storage medium, a computer program is stored therein for implementing the voice synthesis methods provided by the above various embodiments when the computer program is executed by the processor.

Where, the readable storage medium may be a computer storage medium or a communication medium. The communication media includes any medium that facilitates the transfer of a computer program from one place to another. The computer storage medium may be any available media that may be accessed by a general purpose or special purpose computer. For example, the readable storage medium is coupled to a processor, such that the processor may read information from the readable storage medium and may write information into the readable storage medium. Of course, the readable storage medium may also be a part of the processor. The processor and the readable storage medium may be located in application specific integrated circuits (ASIC). Additionally, the ASIC may be located in a user's device. Of course, the processor and the readable storage medium may also reside as discrete components in a communication device. The readable storage medium may be a read only memory (ROM), a random access memory (RAM), a CD-ROM, a magnetic tape, a floppy disk, an optical data storage device, and the like.

The present disclosure also provides a program product including execution instructions stored in a readable storage medium. At least one processor of the device may read the execution instructions from the readable storage medium, and the at least one processor executes the execution instructions such that the device implements the voice synthesis methods provided by the above various embodiments.

In the embodiments of the device, it should be understood that the processor may be a central processing unit (CPU for short), or may be other general purpose processor, digital signal processor (DSP for short), application specific integrated circuit (ASIC for short), etc. The general purpose processor may be a microprocessor or the processor also may be any conventional processor or the like. The steps of the methods disclosed in combination with the present disclosure may be directly embodied as being implemented by the execution of a hardware processor or a combination of hardware and software modules in the processor.

Finally, it should be noted that the foregoing embodiments are merely intended to describe the technical solutions of the present disclosure other than limiting the present disclosure. Although the present disclosure is described in detail with reference to the foregoing embodiments, persons of ordinary skill in the art should understand that they may still make modifications to the technical solutions described in the foregoing embodiments or make equivalent substitutions to some or all technical features therein, and these modifications or substitutions do not make the essence of corresponding technical solutions depart from the scope of the technical solutions of the embodiments of the present disclosure.

What is claimed is:

1. A voice synthesis method, comprising:

obtaining text information and determining characters in the text information and a text content of each of the characters;

performing a character recognition on the text content of each of the characters, to determine character attribute information of the each of the characters;

obtaining speakers in one-to-one correspondence with the characters according to the character attribute information of each of the characters, wherein the speakers are pre-stored speakers having the character attribute information; and generating multi-character synthesized voices according to the text information and the speakers corresponding to the characters of the text information;

wherein the character attribute information comprises a basic attribute, and the basic attribute comprises at least one of a gender attribute and an age attribute;

before the obtaining speakers in one-to-one correspondence with the characters according to the character attribute information of each of the characters, the method further comprises:

determining the basic attribute corresponding to each of the pre-stored speakers according to voice parameter information of the pre-stored speakers; and correspondingly the obtaining speakers in one-to-one correspondence with the characters according to the character attribute information of each of the characters comprises:

for each of the characters, obtaining a speaker having the basic attribute corresponding to the each of the characters, wherein the character attribute information further comprises an additional attribute, and the additional attribute comprises at least one of the following:

regional information, timbre information, and pronunciation style information;

before the obtaining speakers in one-to-one correspondence with the characters according to the character attribute information of each of the characters, the method further comprises:

determining the additional attribute and additional attribute priority corresponding to each of the pre-stored speakers according to the voice parameter information of the pre-stored speakers, and correspondingly the obtaining speakers in one-to-one correspondence with the characters according to the character attribute information of each of the characters further comprises:

determining whether the speaker having the basic attribute corresponding to the character is unique such that the speaker having the basic attribute is the only one of the pre-stored speakers having the basic attribute;

if yes, using the unique speaker as the speaker in one-to-one correspondence with the character;

if no, determining, from speakers having the basic attribute corresponding to the characters, the speakers in one-to-one correspondence with the characters according to the additional attribute;

wherein the determining, from speakers having the basic attribute corresponding to the characters, the speakers in one-to-one correspondence with the characters according to the additional attribute comprises:

obtaining a character voice description class keyword in text contents of the characters, determining the additional attribute corresponding to the characters according to the character voice description class keyword, and in the speakers having the basic attribute corresponding to the characters, using speakers with highest additional attribute priorities as the speakers in one-to-one correspondence with the characters.

2. The method according to claim 1, wherein the obtaining speakers in one-to-one correspondence with the characters according to the character attribute information of each of the characters comprises:

obtaining a candidate speaker for each of the characters according to the character attribute information of the each of the characters;

displaying description information of the candidate speaker to a user and receiving an indication of the user; and obtaining the speakers in one-to-one correspondence with the characters in the candidate speaker of each of the characters according to the indication of the user.

3. The method according to claim 1, wherein the generating multi-character synthesized voices according to the text information and the speakers corresponding to the characters of the text information comprises:

processing a corresponding text content in the text information according to the speakers corresponding to the characters, to generate the multi-character synthesized voices.

4. A device comprising a sender, a receiver, a memory, and a processor;

the memory is configured to store computer instructions; the processor is configured to execute the computer instructions stored in the memory to:

obtain text information and determining characters in the text information and a text content of each of the characters;

perform a character recognition on the text content of each of the characters, to determine character attribute information of the each of the characters;

obtain speakers in one-to-one correspondence with the characters according to the character attribute information of each of the characters, wherein the speakers are pre-stored speakers having the character attribute information; and generate multi-character synthesized voices according to the text information and the speakers corresponding to the characters of the text information;

wherein the character attribute information comprises a basic attribute, and the basic attribute comprises at least one of a gender attribute and an age attribute;

before the obtaining speakers in one-to-one correspondence with the characters according to the character attribute information of each of the characters, the processor is configured to:

determine the basic attribute corresponding to each of the pre-stored speakers according to voice parameter information of the pre-stored speakers; and correspondingly, in the obtaining speakers in one-to-one correspondence with the characters according to the character attribute information of each of the characters, the processor is configured to:

for each of the characters, obtain a speaker having the basic attribute corresponding to the each of the characters, wherein the character attribute information further comprises an additional attribute, and the additional attribute comprises at least one of the following:

regional information, timbre information, and pronunciation style information;

before the obtaining speakers in one-to-one correspondence with the characters according to the character attribute information of each of the characters, the processor is configured to:

determine the additional attribute and additional attribute priority corresponding to each of the pre-stored speakers according to the voice parameter information of the pre-stored speakers, and correspondingly, in the obtaining speakers in one-to-one correspondence with the characters according to the character attribute information of each of the characters, the processor is configured to:

determine whether the speaker having the basic attribute corresponding to the character is unique such that the speaker having the basic attribute is the only one of the pre-stored speakers having the basic attribute;

if yes, using the unique speaker as the speaker in one-to-one correspondence with the character;

if no, determine, from speakers having the basic attribute corresponding to the characters, the speakers in one-to-one correspondence with the characters according to the additional attribute;

wherein in determining, from speakers having the basic attribute corresponding to the characters, the speakers in one-to-one correspondence with the characters according to the additional attribute, the processor is configured to:

obtain a character voice description class keyword in text contents of the characters, determine the additional attribute corresponding to the characters according to the character voice description class keyword, and in the speakers having the basic attribute corresponding to the characters, use speakers with highest additional attribute priorities as the speakers in one-to-one correspondence with the characters.

5. The device according to claim 4, wherein in the obtaining speakers in one-to-one correspondence with the characters according to the character attribute information of each of the characters, the processor is configured to:

obtain a candidate speaker for each of the characters according to the character attribute information of the each of the characters;

display description information of the candidate speaker to a user and receiving an indication of the user; and obtain the speakers in one-to-one correspondence with the characters in the candidate speaker of each of the characters according to the indication of the user.

6. The device according to claim 4, wherein in the generating multi-character synthesized voices according to the text information and the speakers corresponding to the characters of the text information, the processor is configured to:

process a corresponding text content in the text information according to the speakers corresponding to the characters, to generate the multi-character synthesized voices.

7. A storage medium comprising a non-transitory readable storage medium and computer instructions stored in the non-transitory readable storage medium; the computer instructions are configured to implement the voice synthesis method according to claim 1.

8. The method according to claim 3, wherein after the processing a corresponding text content in the text information according to the speakers corresponding to the characters, to generate the multi-character synthesized voices, the method further comprises:

obtaining background audios that are matched with a plurality of consecutive text contents in the text information; and adding the background audio to voices corresponding to the plurality of text contents, in the multi-character synthesized voices.

9. The device according to claim 6, wherein after the processing a corresponding text content in the text information according to the speakers corresponding to the characters to generate the multi-character synthesized voices, the processor is configured to:

obtain background audios that are matched with a plurality of consecutive text contents in the text information; and add the background audio to voices corresponding to the plurality of text contents, in the multi-character synthesized voices.

* * * * *